US008967023B2

(12) United States Patent
Sun

(10) Patent No.: US 8,967,023 B2
(45) Date of Patent: Mar. 3, 2015

(54) INTERNAL HEXAGONAL WRENCH POWER ASSISTING SHANK

(75) Inventor: Shiyu Sun, Shanghai (CN)

(73) Assignee: Shanghai Easy-Use Tools Enterprise Co., Ltd., Shanghai (CN)

( * ) Notice: Subject to any disclaimer, the term of this patent is extended or adjusted under 35 U.S.C. 154(b) by 214 days.

(21) Appl. No.: 13/480,938

(22) Filed: May 25, 2012

(65) Prior Publication Data

US 2012/0297940 A1 Nov. 29, 2012

(30) Foreign Application Priority Data

May 27, 2011 (CN) ..... 2011 1 0140022

(51) Int. Cl.
*B25G 1/06* (2006.01)
*B25B 15/00* (2006.01)

(52) U.S. Cl.
CPC ..... *B25B 15/008* (2013.01); *B25G 1/063* (2013.01)
USPC ..... 81/489; 81/177.5; 81/57.5; 81/440

(58) Field of Classification Search
USPC ..... 81/489, 177.2, 177.7, 57.5, 436–440
See application file for complete search history.

(56) References Cited

U.S. PATENT DOCUMENTS

| | | | | |
|---|---|---|---|---|
| 13,120 | A * | 6/1855 | Bristol | 81/57.5 |
| 687,871 | A * | 12/1901 | Bessette | 81/57.5 |
| 878,197 | A * | 2/1908 | Fisher | 81/57.5 |
| 1,303,595 | A * | 5/1919 | Rifflard | 81/440 |
| 2,384,525 | A * | 9/1945 | Beverly | 81/13 |
| 2,753,745 | A * | 7/1956 | Dossie et al. | 81/57.5 |
| 6,345,557 | B1 * | 2/2002 | Kuo | 81/177.2 |
| 2012/0240731 | A1 * | 9/2012 | Chu | 81/57.5 |

* cited by examiner

*Primary Examiner* — Hadi Shakeri
(74) *Attorney, Agent, or Firm* — Novak Druce Connolly Bove + Quigg LLP

(57) ABSTRACT

An internal hexagonal wrench power assisting shank is disposed with several through holes capable of matching with a diameter of the used power assisting shank and a first gap, and a connection hole is disposed thereon. Different types of handle shanks can be connected through the connection hole. The shank is suitable for internal hexagonal wrenches having different types and can be joined with different kinds of handle shanks such as a straight shank, the ratchet, and an L-shaped hand shank to have flexibility and convenience.

3 Claims, 4 Drawing Sheets

INTERNAL HEXAGONAL WRENCH POWER ASSISTING SHANK

BACKGROUND OF THE INVENTION

1. Field of the Invention

The present invention generally relates to an internal hexagonal wrench power assisting shank.

2. Description of the Related Art

Currently, conventionally internal hexagonal wrenches are difficult to use. In some cases, internal hexagonal wrenches are injected into a handle shank. However, the foregoing manner is extremely restricted to an internal hexagonal wrench and may not be flexibly applied to different types, and furthermore the effect of the ratchet may not be taken as well. Another boring plastic shank on the market is taken as the power assisting shank for using the internal hexagonal wrench. However, the foregoing structure is merely an effect of a T-shaped handle shank without the effect of flexibly application generated by a straight handle shank, a ratchet or a F-type.

SUMMARY OF THE INVENTION

Therefore, to solve the problem existing in the conventional technique, it is an objective of the present invention to provide an internal hexagonal wrench power assisting shank capable of effectively overcoming the foregoing problem existing in the conventional technique.

To achieve the foregoing objective, the present invention provides an internal hexagonal wrench power assisting shank connected to a handle shank. The power assisting shank is disposed with several through holes capable of matching with an external diameter of the used wrench and a first gap.

The invention further comprises a rotary member. The rotary member is disposed with several through holes in which one end has the first gap. The rotary member is movably connected to a lodging member through a shaft at the same direction together with the through hole. A second gap is disposed on a first surface of the lodging member connected to one end of the rotary member having the gap.

A second surface of the lodging member has a connection hole, and a handle shank is connected by the connection hole.

The lodging member is η-shaped lodging member composed of the first surface, the second surface and a third surface, and the lodging member is movably connected to the rotary member through the first surface and the third surface.

The rotary member is a straight prism, and a direction of the through hole is parallel with a central axis of the straight prism.

The power assisting shank is a straight prism power assisting shank, and the through hole passes through the side surface of the straight prism power assisting shank and is parallel with its bottom surface, and the first gap is parallel with a side prism of the straight prism power assisting shank and passes through a bottom surface of the straight prism power assisting shank, and another bottom surface is disposed with a connection hole, and a handle shank is connected by the connection hole.

Since the foregoing technique manners are adopted, the internal hexagonal wrench power assisting shank of the invention is suitable for internal hexagonal wrenches with different types and can be connected to different kinds of handle shanks such as a straight handle shank, a ratchet, a an L-shaped handle shank to have convenience and flexibility.

BRIEF DESCRIPTION OF THE DRAWINGS

The detailed structure, operating principle and effects of the present invention will now be described in more details hereinafter with reference to the accompanying drawings that show various embodiments of the invention as follows.

DETAILED DESCRIPTION OF THE PREFERRED EMBODIMENTS

The technical content of the present invention will become apparent by the detailed description of the following embodiments and the illustration of related drawings as follows.

Figure 1:
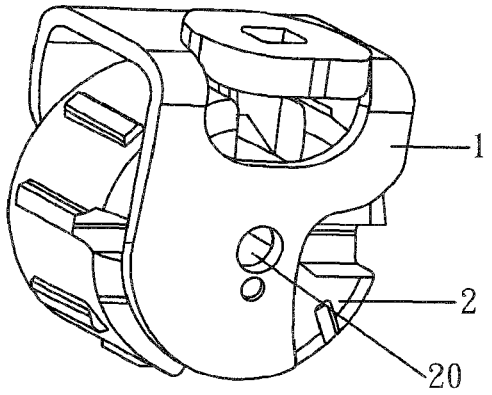
FIG. 1 is a structural diagram according to the present invention.
Figure 2:
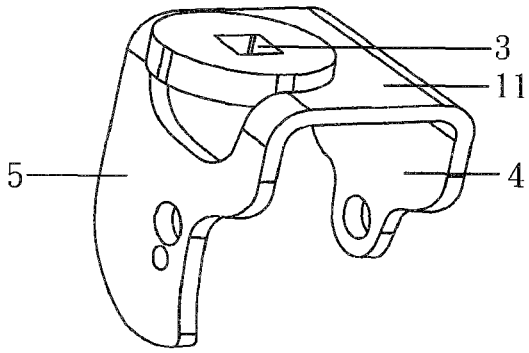
FIG. 2 is a first diagram of a structure of a lodging member according to the present invention.
Figure 3:
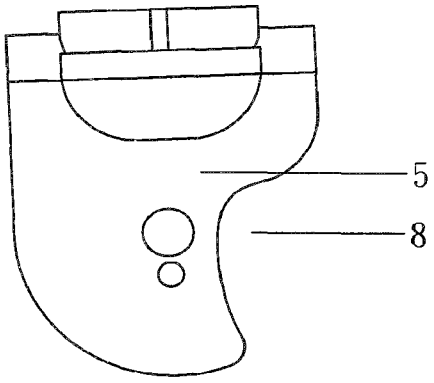
FIG. 3 is a second diagram of a structure of a lodging member according to the present invention.
Figure 4:
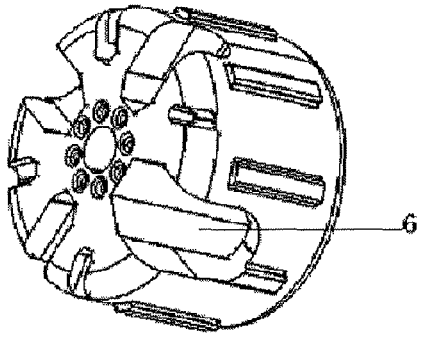
FIG. 4 is a first diagram of a structure of a rotary member according to the present invention.
Figure 5:
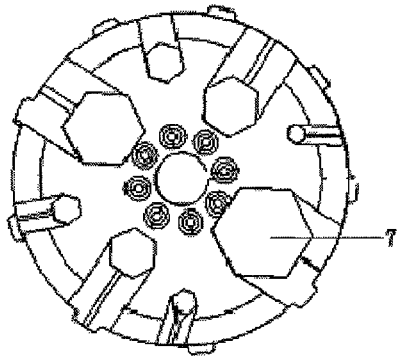
FIG. 5 is a second diagram of a structure of a rotary member according to the present invention.
Figure 6:
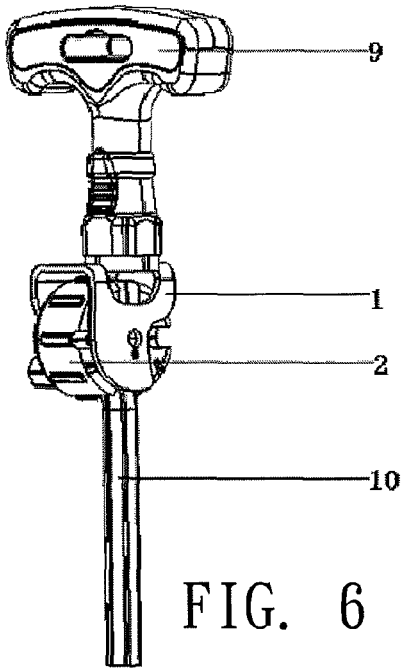
FIG. 6 is a structural diagram of a rotary member according to a first embodiment of the invention.
Figure 7:
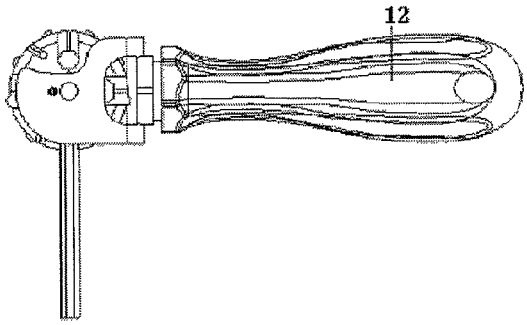
FIG. 7 is a structural diagram of a rotary member according to a second embodiment of the invention.
Figure 8:
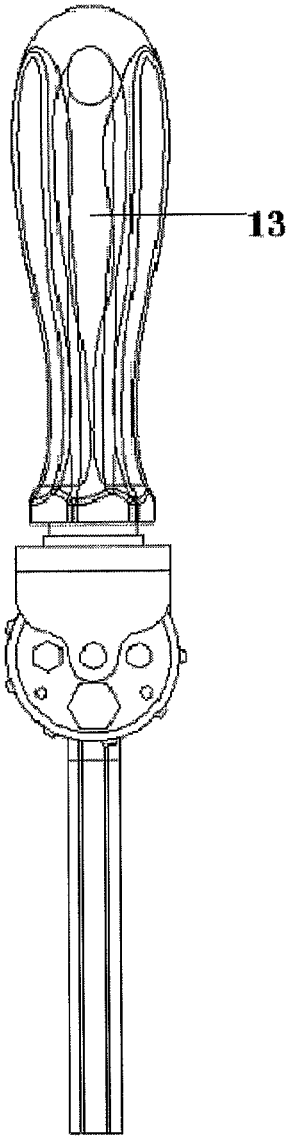
FIG. 8 is a structural diagram of a rotary member according to a third embodiment of the invention.
Figure 9:
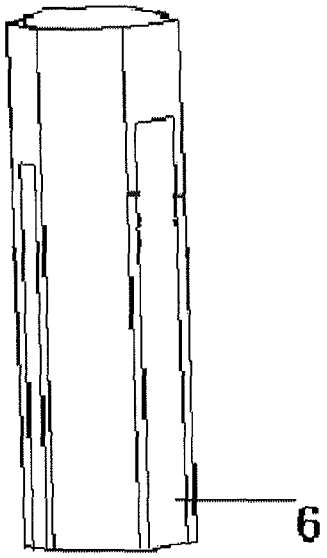
FIG. 9 is another structural diagram according to the invention.
Figure 10:
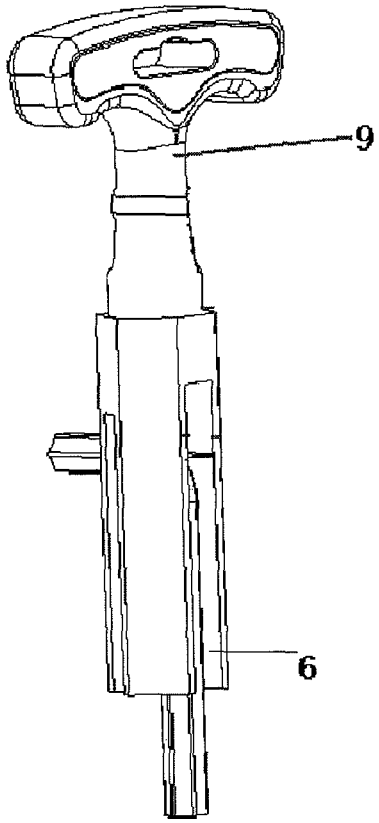
FIG. 10 is a structural diagram according to another embodiment of the invention.

With reference to FIG. 1 and FIG. 10 for an internal hexagonal wrench power assisting shank is connected to a handle shank. The handle shank is disposed with several through holes 7 capable of matching an external diameter of the used wrench and a first gap 6. The internal hexagonal wrench power assisting shank can be selectively connected to different handle shanks, such as a T-shaped handle shank 9 or a ratchet handle shank, a straight handle shank 13, an L-shaped handle shank 12, based upon demands to satisfy different choices of customers. Further, the handle shank can be movably connected or fastened as a whole.

In an embodiment of the invention, the power assisting shank comprises a rotary member 2 as a straight prism. The rotary member is disposed with several through holes 7 in which one end has the first gap 6. The sizes of the through holes 7 and the first gap 6 are matched with the external diameter of the internal hexagonal wrench 10. The through hole 7 is along a central axis direction of the straight prism. The rotary member 2 is movably connected a lodging member 1 through a shaft 20 of passing through the central axis. The rotary member 2 can surround the shaft to rotate relative the lodging member 1.

The lodging member 1 is a η-shaped lodging member 1 composed of a first surface 5, a second surface 11 and a third surface 4. The lodging member 1 is movably connected to the rotary member 2 through its first surface 5 and the third surface 4. While in fastening, the first surface 5 is fastened with one end of the first gap 6 of the rotary member 2.

The second surface 11 of the lodging member 1 is disposed with a connection hole 3. The handle shank is connected by the connection hole 3.

While in use, the through hole 7, which matches with the hexagonal wrench 10, of the rotary member 2 is rotated to a second gap 8 of the lodging member 1 to allow the short shank of the internal hexagonal wrench 10 passing through the through hole 7 of the rotary member 2. Afterward, the rotary member 2 is rotated, and the first surface 5 is utilized to buckle the internal hexagonal wrench 10 to prevent sliding when the force is imposed.

Another embodiment of the invention is that the power assisting shank is a straight prism. The through hole 7 passes through the side surface of the power assisting shank having the straight prism and is parallel its bottom surface. The first gap 6 is parallel the side surface of the straight prism power assisting shank and passes through the bottom surface of the power assisting shank having the straight prism while another bottom surface is disposed with the connection hole 3. While in use, a short end of the internal hexagonal wrench 10 passes through the through hole 7. A longer end is lodged into the first gap 7 of a handle shank. The connection hole 3 can be connected to different handle shanks. The user may have multiple choices to increase the convenience.

While the means of specific embodiments in present invention has been described by reference drawings, numerous modifications and variations could be made thereto by those skilled in the art without departing from the scope and spirit of the invention set forth in the claims. The modifications and variations should also fall within the protection scope of the present invention.

What is claimed is:

1. An internal hexagonal wrench power assisting shank connected to a handle shank, and the internal hexagonal wrench power assisting shank comprising:

a lodging member; and a rotary member disposed with a plurality of through holes and a first gap that vias one of the through holes so as to capable of matching with an external diameter of an internal hexagonal wrench, and the rotary member movably connected to the lodging member through a shaft at a same direction together with the through hole, wherein the rotary member is a column, the through holes formed on an end surface of the column and the first gap is formed on a side surface of the column, wherein a second gap is disposed on a first surface of the lodging member and the first surface of the lodging member is connected to one end of the rotary member having the through holes, a second surface of the lodging member is disposed with a connection hole, and the lodging member has a cross-section in a shape of an open rectangle having two opposing edges of different lengths and is composed of the first surface, the second surface adjacent the first surface and a third surface adjacent the second surface, a length of the first surface is larger than a length of the third surface and the lodging member is movably connected to the rotary member through the first surface and the third surface.

2. The internal hexagonal wrench power assisting shank of claim 1, wherein a direction of the plurality of through holes is parallel with a central axis of the column.

3. The internal hexagonal wrench power assisting shank of claim 1, wherein the lodging member disposed with a connection hole so as to connect with the handle shank.

* * * * *